United States Patent [19]

Veitl

[11] 4,041,749

[45] Aug. 16, 1977

[54] METHOD OF PRODUCING SHEET OR PLATE FROM ROLLING STOCK

[75] Inventor: Giswalt Veitl, Linz, Austria

[73] Assignee: Vereinigte Osterreichische Eisen-und Stahlwere- Alpine Montan Aktiengesellschaft, Linz, Austria

[21] Appl. No.: 741,760

[22] Filed: Nov. 15, 1976

[30] Foreign Application Priority Data

Nov. 24, 1975 Austria ..... 8907/75

[51] Int. Cl.[2] ..... B21B 1/02

[52] U.S. Cl. ..... 72/187; 72/198; 72/366; 72/240

[58] Field of Search ..... 72/187, 197, 198, 240, 72/365, 366; 29/527.7

[56] References Cited

U.S. PATENT DOCUMENTS

| | | | |
|---|---|---|---|
| 1,106,172 | 8/1914 | Wetcke | 72/197 |
| 3,955,391 | 5/1976 | Wilson | 72/240 |

*Primary Examiner*—Lowell A. Larson
*Attorney, Agent, or Firm*—Bierman & Bierman

[57] ABSTRACT

In a method and apparatus for producing sheets or plates by hot rolling slabs in a number of passes, the slabs are alternately deformed more strongly and less strongly between a pair of rolls at least in one pass, and when the slabs are less strongly deformed, a condition according to which $\alpha'$ is equal to or smaller than $\rho$ is observed, while when the slabs are more strongly deformed, a condition according to which $\rho$ is smaller than $\alpha$ smaller than 2 $\rho$ is observed, $\alpha$ and $\alpha'$ being the angles of engagement and $\rho$ being the angle of friction, and differences in thickness in longitudinal direction of the slabs are levelled out in a subsequent pass.

9 Claims, 5 Drawing Figures

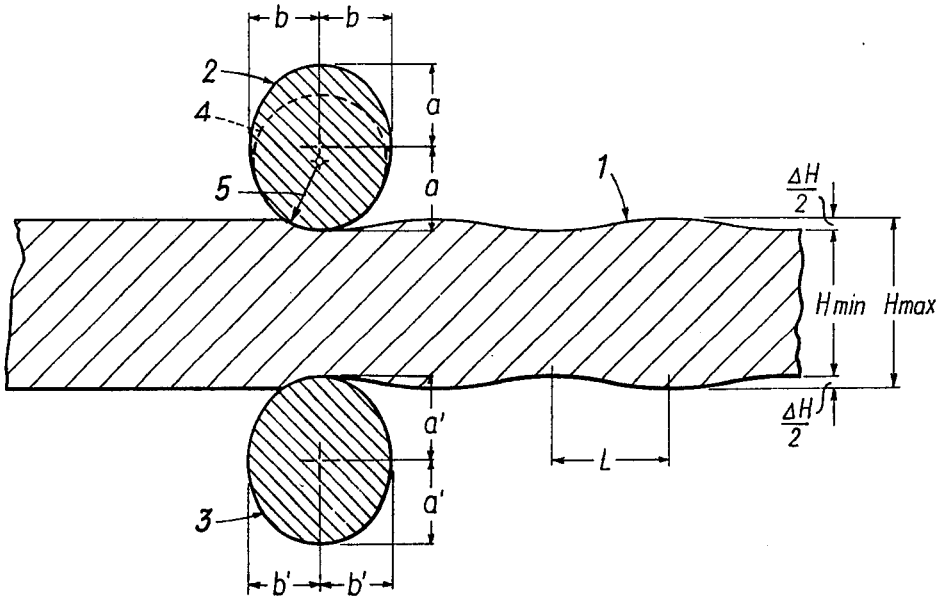
b
b
2
4
5
a
a
1
ΔH/2
Hmin
Hmax
ΔH/2
a'
a'
L
3
b'
b'

METHOD OF PRODUCING SHEET OR PLATE FROM ROLLING STOCK

The invention relates to a method of producing sheet or plate, in particular heavy plate having a thickness exceeding 100 mm, by hot rolling of slabs, in particular continuously cast slabs, in a number of passes, wherein the rolling stock — at least in one pass — is alternately deformed more strongly and less strongly between a pair of rolls, as well as to an apparatus for carrying out this method.

In the field of steel construction there is an increasing demand for plate of relatively great thickness; in particular, for the construction of nuclear power plants plate having a thickness up to 350 mm is needed. For the production of plate in a thickness range of between 100 and 350 mm, crude slabs having a weight of between 20 metric tons and approximately 100 metric tons are used. In the process of making such plate, an increasing number of faults occurs with an increasing weight of the crude slabs. The faults are interior faults such as loose places and fissures. A further fault which can occur when producing thick austenitic Cr-Ni-Steel plate is coarse grain formation, which often occurs due to an insufficient working up per pass - in particular in the core zone of the plate.

The invention aims at preventing these disadvantages and difficulties and has as its object to create a method of the above defined kind which makes it possible to produce faultless plate even with plate thicknesses exceeding 100 mm. Loose places and fissures are to be reliably caused to weld together and the cast structure in the core zone of the rolling stock is to be transformed into a rolled structure.

According to the invention, this object is achieved in that during the lesser deformation the condition $\alpha'$ equal to or smaller than $\rho$, and during the stronger deformation the condition $\rho$ smaller than $\alpha$ smaller than $2\rho$ is observed, and $\alpha$, $\alpha'$ represent the angle of engagement and $\Delta$ represents the angle of friction, whereupon the differences in thickness in longitudinal direction of the rolling stock are levelled out in a subsequent pass. This condition, which according to the invention is observed for at least one rolling pass, can also be met in more than one pass, but need not be applied in each pass, i.e. a number of passes can be carried out, especially during broadside rolling, in which the rolling stock during a rolling pass is alternately undeformed and deformed to a lesser degree than corresponds to the condition $\rho$ smaller than $\alpha$ smaller than $2\rho$.

Advantageously, the rolling stock is deformed by between 2 and 6% during the lesser deformation and by between 5 and 12% during the stronger deformation.

Suitably, the rolling stock is rolled in a number of rolling passes with alternating stronger and lesser deformation, wherein after each one of these rolling passes the differences in thicknesses are levelled out.

According to a preferred embodiment, the deformation conditions are adjusted in a manner that the ratio of the difference $\Delta H$ of the greatest thickness Hmax and the smallest thickness Hmin of the rolling stock to their shortest distance L is in a range between 0.07 and 0.012.

An apparatus suitable for carrying out this method, which is provided with at least one pair of work rolls having convex roll surfaces extending over their peripheries, is characterised in that at least one of the work rolls is provided with an axis-parallel elevation protruding beyond a circular cross-section and extending over its entire length.

A preferred embodiment is characterised in that one roll of the pair of work rolls has an elliptical cross-section, the axis of rotation being located in the center of the ellipse, and that, if desired, a further pair of work rolls is arranged to follow thereupon, whose work rolls have a circular cross-section.

According to further features of the invention two opposing work rolls have elliptical cross-section, wherein the semiaxes of the ellipse, *a, b,* of one work roll, in the positions of the work rolls in which the roll gap is the widest or the narrowest, are parallel to the corresponding semiaxes, *a', b',* of the other work roll.

Furthermore, advantageously the length of the short axis of the ellipse forming the cross-section of the work roll amounts to between 90 and 99% of the length of the long axis of the ellipse.

The invention shall now be described by way of two examples and with reference to the accompanying schematical drawing.

In the drawing, a rolled product 1 ist illustrated after application of the rolling pass according to the invention, wherein the smallest thickness of the rolling stock treated according to the invention is designated by Hmin and the greatest thickness is designated by Hmax. The opposing work rolls 2, 3 have an elliptical cross-section. In the position of the work rolls illustrated, the roll gap formed by them has the smallest height. The semiaxes *a, b,* of the ellipse of the work roll 2, in this position are parallel to the corresponding semiaxes *a', b',* of the ellipse of the work roll 3. The axis of rotation of each work roll is located at the center of the ellipse. The rolling stock rolled according to the invention shows wave-like shaped surfaces, wherein a wave trough has a distance from a wave crest designated by L. This distance corresponds to about one quarter of the roll circumference by the work rolls 2, 3.

For determining the angle of engagement by approximation, suitably the elliptical work roll is substituted by a circular cylindrical roll 4 having a roll radius corresponding to the radius 5 of the circle of curvature of the arc of the elliptical work roll that is in contact with the rolling stock 1.

EXAMPLE 1

From a steel of a quality used for making low-alloyed boiler plates having a high temperature strength, an ingot having the dimensions 3000 × 2000 × 950 mm³ was cast, which was rolled to give a plate of the dimensions 6620 × 3600 × 240 mm³. After heating to 1280° C the ingot was brought to a two-stand plate mill. According to the invention, as cogging stand an elliptical-roll stand having two work rolls was provided; the axes of the ellipses of the elliptical work rolls equal among themselves were 1000 mm and 960 mm. The stronger deformation, with a reduction of 80 mm per pass, corresponds to an angle of engagement of approximately 24°5'. The empirically found value for the angle of friction $\rho$ amounts to 16°30'. In this deformation thus the condition $\rho$ smaller than $\delta$ smaller than $2\rho$ (16°30' smaller than 24°5' smaller than 33°) is met. The slighter deformation, with a decrease of 40 mm, corresponds to an angle of engagement $\alpha'$ of approximately 15°35'. The empirically found angle of friction again amounts to 16°30'. Thus the condition $\alpha'$ equal or smaller than $\rho$ (15°35' smaller than 16°30') is met. A finishing stand was arranged to follow thereupon as a four-high rolling stand having (circular) cylindrical work rolls. The rolling procedure is shown in the following pass plan 1. Hmin means the narrowest thickness and Hmax the greatest thickness of the rolling stock after application of the roll pass according to the invention on the elliptical-roll stand. In each roll pass according to the invention, one started in that position, in which the roll gap of the elliptical roll pair is the widest.

Pass plan 1

| Direction of rolling | Pass No. | Cogging stand Elliptical-roll stand Hmax (mm) | degree of deformation (%) | Hmin (mm) | degree of deformation (%) | finishing stand cylindrical work rolls H (mm) |
|---|---|---|---|---|---|---|
| lengthening | 1 | 910 | 4.2 | 870 | 8.5 | |
| | 2 | | | | | 860 |
| | 3 | 320 | | 780 | | |
| | 4 | | 4.65 | | 9.3 | 770 |
| | 730 | 5.5 | 690 | 11 | | |
| | 6 | | | | | 680 |
| turning broadening | 7 | 680 | 0 | 640 | 5.9 | |
| | 8 | | | | | 630 |
| | 9 | 630 | 0 | 590 | 6.4 | |
| | 10 | | | | | 580 |
| | 11 | 580 | 0 | 540 | 6.9 | |
| | 12 | | | | | 530 |
| | 13 | 530 | 0 | 490 | 7.5 | |
| | 14 | | | | | 480 |
| | 15 | 480 | 0 | 440 | 8.3 | |
| | 16 | | | | | 430 |
| | 17 | 430 | 0 | 390 | 9.3 | |
| | 18 | | | | | 380 |
| turning lengthening | | Continued rolling in common manner at finishing stand | | | | 240 |

During passes 1, 3 and 5, the rolled product was alternately deformed to a greater and lesser degree corresponding to the previously stated conditions $\alpha'$ equal to or smaller than $\rho$, or $\rho$ smaller than $\alpha$ smaller than $2\rho$. The passes 2, 4 and 6 are plane passes, in which the differences in thickness are levelled out. In the passes 7, 9, 11, 13, 15 and 17, the roll adjustment of the elliptical rolls was such that the rolling stock - during a pass - alternately remains undeformed and deformed to a lesser degree than corresponds to the condition $\rho$ smaller than $\alpha$ smaller than $2\rho$. The passes 8, 10, 12, 14, 16 and 18 again are plane passes for levelling off the difference in thickness.

An examination of the plate produced, by means of an ultrasonic test showed a perfect quality without faults. Samples were taken from the head and foot end of the plate. The metallographic findings after etching with diluted nitric acid showed a mean grain size according to ASTM of from 6 to 7. Fissures and piping areas could not be found.

EXAMPLE 2

A continuously cast slab of a Cr-Ni-steel of the type 18/8 was heated to 1220° C in a pusher-type furnace and brought to the elliptical-roll stand of the invention for deforming. The continuously cast slab had the dimensions $3000 \times 1600 \times 300$ mm$^3$. From this a plate having the dimensions $6000 \times 2200 \times 110$ mm$^3$ was produced. The axes of the ellipses of the work rolls were 1010 mm and 995 mm. The finishing stand following thereupon as equipped with (circular) cylindrical work rolls. The continuously cast slab was rolled according to the pass plan below.

The stronger deformation, with a decrease of 50 mm, corresponds to an angle of engagement $\alpha$ of about 18°30'. The angle of friction $\rho$, as was empirically found, is 16°30'. Thus, with the stronger deformation, the condition $\rho$ smaller than $\alpha$ smaller than $2\rho$ (16°30' smaller than 18°30' smaller than 33°) is met. The slighter deformation corresponds with a decrease of 35 mm to an angle of engagement $\alpha'$ of approximately 15°5', thus the condition $\alpha'$ equal to or smaller than $\rho$ (15°5' smaller than 16°30') being met.

Pass plan 2

| Direction of rolling | Pass No. | Cogging stand Elliptical-roll stand Hmax (mm) | Hmin (mm) | degree of deformaton (%) | finishing stand cylindrical work rolls H (mm) |
|---|---|---|---|---|---|
| lengthening | 1 | 265 | 250 | 11.7 - 16.6 | |
| | 2 | 250 | 235 | 0 - 11.3 | |
| | 3 | 235 | 220 | 0 - 12.0 | |
| | 4 | | | | 220 |
| turning broadening | 5 | 205 | 190 | 6.8 - 13.7 | |
| | 6 | 190 | 175 | 0 - 14.6 | |
| | 7 | 175 | 160 | 0 - 15.8 | |
| turning lengthening | | Continued rolling in common manner at finishing stand | | | 110 |

Passes 1 to 3 were carried out and the elliptical-roll stand. During the passes 2 and 3 the degree of deformation is dependent on the size of the roll gap when the pass begins, i.e. dependent upon the position in which the elliptical work rolls are when gripping the rolling stock. After pass 3, a longitudinal pass was carried out on the finishing stand for levelling out the differences in thickness. Broadening was carried out on the elliptical-roll stand, wherein for passes 6 and 7 the degree of deformation was dependent upon the size of the roll gap at the beginning of the pass in the same manner as for passes 2 and 3.

As the metallographic findings showed, the plate was free from coarse grain. The grain size according to ASTM was determined to be 5 to 6.

What I claim is:

1. In a method of producing sheet or plate from rolling stock in particular heavy plate having a thickness in excess of 100 mm, by hot rolling slabs, in particular continuously cast slabs, in a number of passes, wherein at least in one pass, the rolling stock is alternately deformed more strongly and less strongly between a pair of rolls, the improvement which comprises, when the rolling stock is less strongly deformed, observing the condition: $\alpha'$ equal to or smaller than $\rho$, and, when the rolling stock is more strongly deformed, observing the condition: $\rho$ smaller than $\alpha$ smaller than $2\rho$, $\alpha$ and $\alpha'$ representing the angles of engagement and $\rho$ representing the angle of friction, and levelling out differences in thickness in longitudinal direction of the rolling stock in a subsequent pass.

2. A method as set forth in claim 1, wherein, when the rolling stock is less strongly deformed, it is deformed by between 2 and 6%, and, when the rolling stock is more strongly deformed, it is deformed by between 5 and 12%.

3. A method as set forth in claim 1, wherein the rolling stock is deformed more strongly and less strongly in a number of passes, the differences in thickness being levelled out after each of said passes.

4. A method as set forth in claim 1, wherein deformation conditions are adjusted which result in a ratio of the difference ($\Delta H$) between the greatest thickness (Hmax) of the rolling stock and the smallest thickness (Hmin) of the rolling stock to the shortest distance (L) between the greatest thickness and the smallest thickness of the rolling stock, ranging between 0.07 and 0.012.

5. In an apparatus for producing sheet or plate, in particular heavy plate having a thickness in excess of 100 mm, by hot rolling slabs, in particular continuously cast slabs, in a number of passes, wherein at least in one pass the slabs are alternately deformed more strongly and less strongly between at least one pair of work rolls, each having a convex roll surface extending over its periphery, the improvement which is characterised in that at least one of said work rolls is provided with an elevation extending parallel to the axis of the roll and over the entire length thereof which elevation protrudes beyond a circular cross-section.

6. An apparatus as set forth in claim 5, wherein at least one roll of at least one pair of work rolls has a cross-section forming an ellipse, the axis of rotation of the roll being located at the center of the ellipse.

7. An apparatus as set forth in claim 6, comprising a further pair of work rolls whose work rolls have circular cross-sections, said further pair of work rolls being arranged to follow upon said at least one pair of work rolls.

8. An apparatus as set forth in claim 6, wherein two opposing work rolls of the at least one pair of work rolls that form a roll gap have cross-sections each forming an ellipse, the semiaxes of the ellipse of one of said work rolls being parallel to the corresponding semiaxes of the ellipse of the opposing work roll in positions of the work rolls where the roll gap between them is at its widest and narrowest.

9. An apparatus as set forth in claim 8, wherein the short axis of each ellipse has a length amounting to between 90 and 99% of the pertaining long axis.

* * * * *

UNITED STATES PATENT OFFICE

CERTIFICATE OF CORRECTION

PATENT NO. : 4,041,749

DATED : August 16, 1977

INVENTOR(S) : GISWALT VEITL

It is certified that error appears in the above-identified patent and that said Letters Patent are hereby corrected as shown below:

In the Heading, item [73] line 2 cancel "Stahlwere" insert --Stahlwerke--

Column 1, line 41 Cancel "$\Delta$" insert --$\rho$--

Column 2, line 61 Cancel "$\delta$" insert --$\alpha$--

Column 3 amend Pass No. 3 and 9 and align Pass No. 5 with Pass. No. 4 as follows:

| | | | | | |
|---|---|---|---|---|---|
| 3 | 820 | | 780 | | |
| 4 | | 4.65 | | 9.3 | 770 |
| 5 | 730 | 5.5 | 690 | 11 | |
| 9 | 630 | 0 | 590 | 6.3 | |

Column 3, line 61 Cancel "as" insert --was--

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*